US009687123B2

(12) United States Patent
Burk

(10) Patent No.: US 9,687,123 B2
(45) Date of Patent: Jun. 27, 2017

(54) PERSONAL HYGIENE DEVICES

(71) Applicant: Juliet Colyer Burk, Tahlequah, OK (US)

(72) Inventor: Juliet Colyer Burk, Tahlequah, OK (US)

( * ) Notice: Subject to any disclaimer, the term of this patent is extended or adjusted under 35 U.S.C. 154(b) by 484 days.

(21) Appl. No.: 14/216,347

(22) Filed: Mar. 17, 2014

(65) Prior Publication Data

US 2014/0261542 A1 Sep. 18, 2014

Related U.S. Application Data

(60) Provisional application No. 61/789,125, filed on Mar. 15, 2013.

(51) Int. Cl.

| | |
|---|---|
| ***A47K 7/04*** | (2006.01) |
| ***A47L 7/02*** | (2006.01) |
| ***A47K 7/02*** | (2006.01) |

(52) U.S. Cl.

CPC ..... *A47K 7/026* (2013.01); *A47K 7/043* (2013.01)

(58) Field of Classification Search

CPC ..... A47K 7/026; A47K 7/043

See application file for complete search history.

(56) References Cited

U.S. PATENT DOCUMENTS 737,135 A * 8/1903 Peacook ..... A47L 13/00 15/233
2,134,965 A * 11/1938 Zbarsky ..... A46B 7/04 15/118
2,271,694 A * 2/1942 Johnson ..... A47L 4/02 15/394
2,663,046 A * 12/1953 Goguen ..... A47L 4/02 15/160
2,856,625 A * 10/1958 Delacretaz ..... A47L 4/02 15/220.3
4,435,874 A * 3/1984 Jacobson ..... A47L 4/02 15/220.3
4,718,141 A * 1/1988 Kuehnl ..... A47L 4/02 15/220.3
4,787,118 A * 11/1988 Weiland ..... A47L 4/02 15/220.3
6,261,379 B1 * 7/2001 Conrad ..... A47L 5/34 134/21
7,194,783 B1 * 3/2007 Hunt ..... A47L 4/02 15/321
7,430,781 B2 * 10/2008 Collins ..... A47L 4/02 15/220.3
8,261,401 B1 * 9/2012 Ciesielski ..... A47L 4/02 15/104.93
8,266,757 B2 * 9/2012 Jaeger ..... A47L 4/00 15/102

(Continued)

*Primary Examiner* — Michael Jennings

(57) ABSTRACT

The present invention discloses personal hygiene device or cleaning devices and cleaning apparatuses. The cleaning devices include an elongate member, at least one housing coupled to a proximal end of the elongate member, at least one agitation mechanism movably coupled to the at least one housing, and a cleaning device removably coupled to the at least one housing. The cleaning apparatuses include a cleaning portion, a first attachment portion at a first end of the cleaning portion, and a second attachment portion at a second end of the cleaning portion. Methods of using the cleaning devices are also disclosed.

16 Claims, 12 Drawing Sheets

(56) References Cited

U.S. PATENT DOCUMENTS

| | | | | |
|---|---|---|---|---|
| 8,745,808 | B2 * | 6/2014 | Best | B05C 17/00 15/209.1 |
| 2011/0035894 | A1 * | 2/2011 | Goldhammer | A46B 5/0008 15/160 |

* cited by examiner

PERSONAL HYGIENE DEVICES

CROSS REFERENCE

This application claims priority benefit under 35 U.S.C. §119(e) of U.S. provisional application No. 61/789,125 filed Mar. 15, 2013, which is incorporated herein by reference in its entirety.

FIELD OF THE INVENTION

The present invention relates generally to personal hygiene devices. More specifically, but not exclusively, the present invention concerns cleaning devices to improve cleaning of the feet, between the toes, and other body parts.

BACKGROUND OF THE INVENTION

Currently available devices for cleaning feet and toes may be difficult to use, especially for people with limited flexibility and mobility. Therefore, a need exists for a new and improved cleaning device that is easier to use.

SUMMARY OF THE INVENTION

Aspects of the present invention provide cleaning devices, a cleaning apparatus, and methods for cleaning a foot using the cleaning device.

In one aspect, provided herein is a cleaning device including an elongate member and at least one housing extending out from a proximal end of the elongate member. The cleaning device may also include at least one agitation mechanism coupled to the at least one housing. The cleaning device may further include a cleaning device removably coupled to the at least one housing.

In another aspect, provided herein is a cleaning apparatus including a cleaning portion, a first attachment portion, and a second attachment portion. The first attachment portion is at a first end of the cleaning portion and the second attachment portion is at a second end of the cleaning portion.

In yet another aspect, provided herein is a method for cleaning a foot including obtaining a cleaning device. The cleaning device may include an elongate member, at least one housing, at least one agitation mechanism, and a cleaning apparatus. The at least one housing extending out from a proximal end of the elongate member and the at least one agitation mechanism coupled to the at least one housing. The cleaning device also includes a cleaning apparatus removably coupled to the at least one housing. The method may also include activating the at least one agitation member to move the cleaning apparatus. The method may further include engaging the cleaning apparatus with a foot. In addition, the method may include moving the cleaning device to pass the cleaning apparatus over the foot.

These, and other objects, features and advantages of this invention will become apparent from the following detailed description of the various aspects of the invention taken in conjunction with the accompanying drawings.

BRIEF DESCRIPTION OF DRAWINGS

The accompanying drawings, which are incorporated in and constitute a part of the specification, illustrate embodiments of the invention and together with the detailed description herein, serve to explain the principles of the invention. The drawings are only for purposes of illustrating preferred embodiments and are not to be construed as limiting the invention. It is emphasized that, in accordance with the standard practice in the industry, various features are not drawn to scale. In fact, the dimensions of the various features may be arbitrarily increased or reduced for clarity of discussion. The foregoing and other objects, features and advantages of the invention are apparent from the following detailed description taken in conjunction with the accompanying drawings in which.

DETAILED DESCRIPTION FOR CARRYING OUT THE INVENTION

Generally stated, disclosed herein are a number of embodiments of a cleaning device. The terms "cleaning device," "personal hygiene device," "foot and toe cleaning device," "device," and "foot and toe cleaning apparatus" may be used interchangeably as they essentially describe the same type of device. The cleaning device typically includes an elongate member, at least one housing, at least one agitation mechanism, and a cleaning apparatus. Further, a cleaning apparatus which may be used with the cleaning device is also disclosed. Finally, described herein is a method for cleaning a foot using a cleaning device.

In this detailed description and the following claims, the words proximal, distal, anterior, posterior, medial, lateral, superior and inferior are defined by their standard usage for indicating a particular part of a foot or device according to the relative disposition of the natural foot or directional terms of reference. For example, "proximal" means the portion of a device nearest the torso, while "distal" indicates the portion of the device farthest from the torso. As for directional terms, "anterior" is a direction towards the front side of the body, "posterior" means a direction towards the back side of the body, "medial" means towards the midline of the body, "lateral" is a direction towards the sides or away from the midline of the body, "superior" means a direction above and "inferior" means a direction below another object or structure. In addition, for the purposes of this disclosure when referencing the device, the term "proximal" will mean the portion of the device closest or nearest the elongate member or handle. The term "distal" shall mean the portion of the device farthest away from the elongate member or handle.

Figure 4:
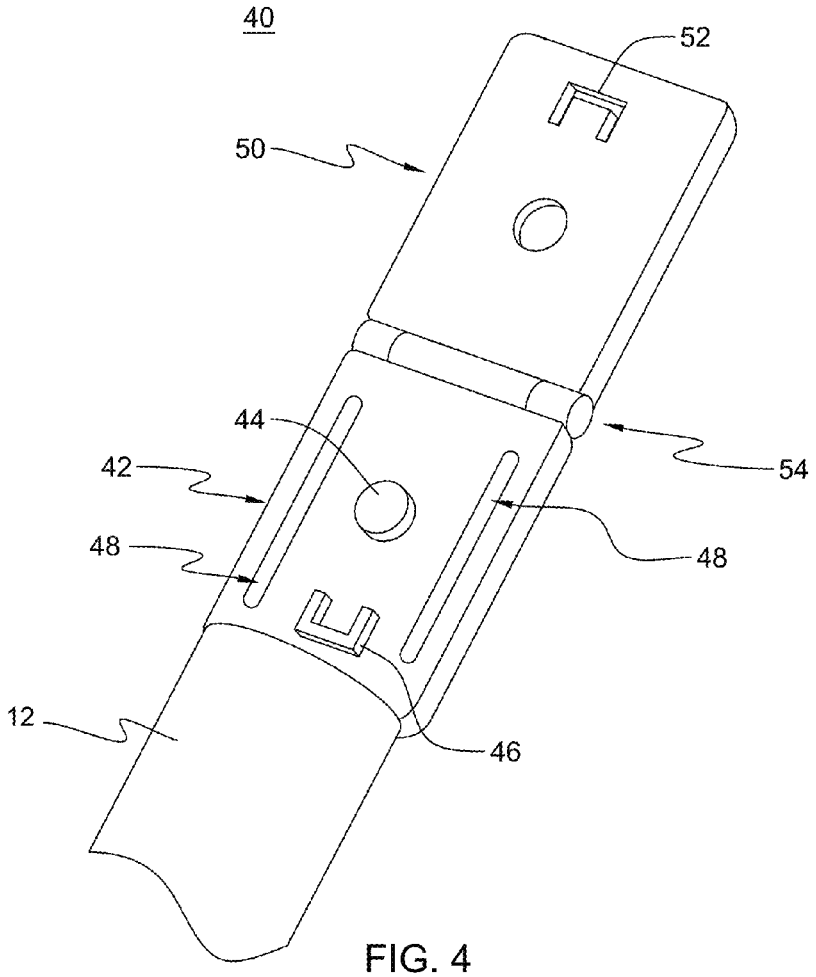
FIG. 4 is a front view of a securement member of the cleaning device of FIG. 1 in an open position, in accordance with an aspect of the present invention.
Figure 5:
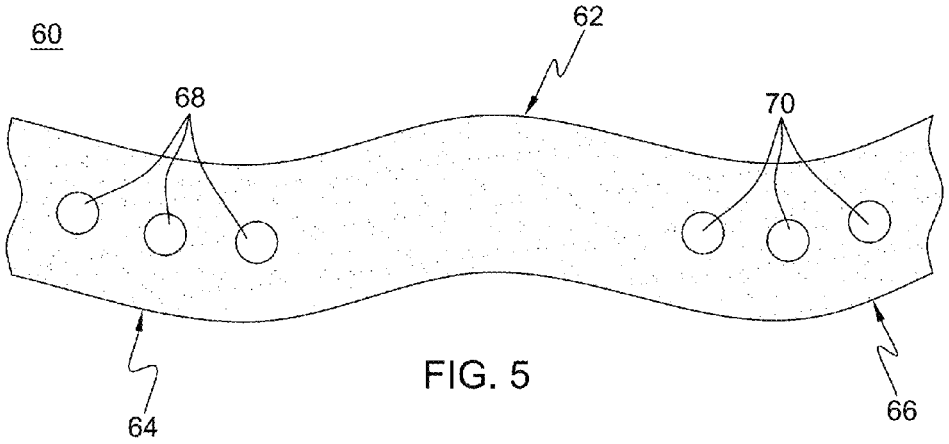
FIG. 5 is a front view of a cleaning apparatus for the cleaning device of FIG. 1, in accordance with an aspect of the present invention.
Figure 6:
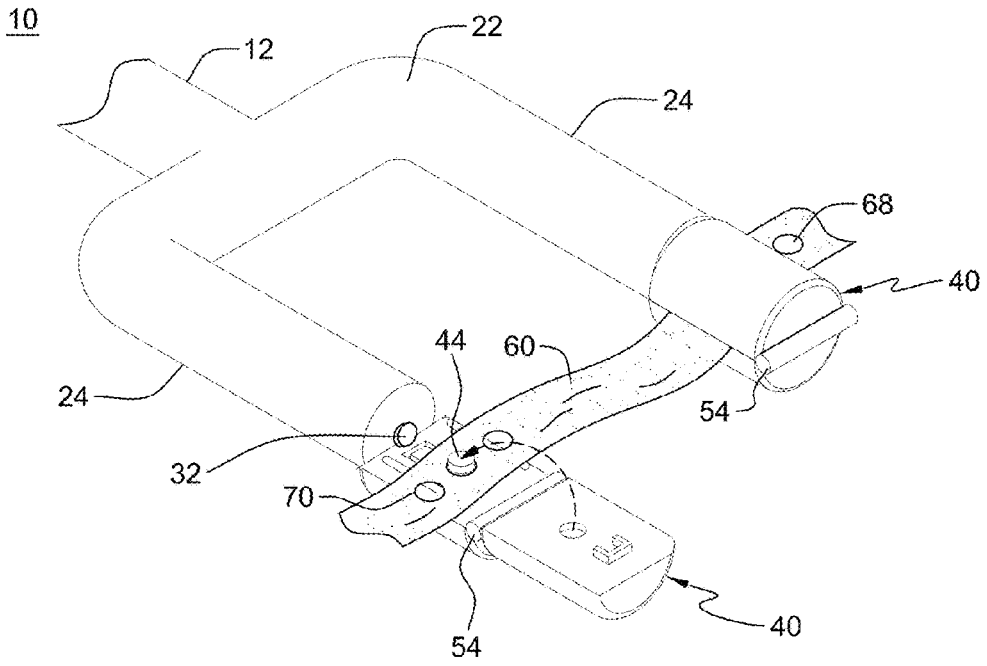
FIG. 6 is an isometric view of a portion of the cleaning device of FIG. 1 with the cleaning apparatus of FIG. 5 partially inserted, in accordance with an aspect of the present invention.
Figure 7:
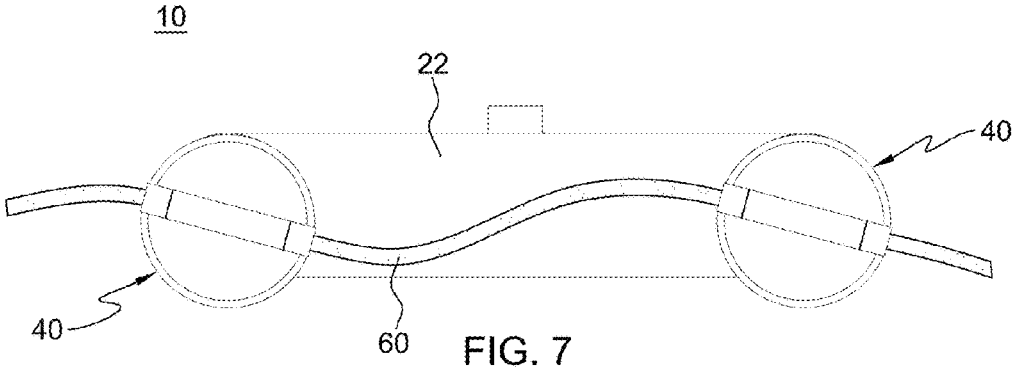
FIG. 7 is a top view of the cleaning device of FIG. 1 with the clamps in a closed position and the cleaning apparatus of FIG. 5 inserted, in accordance with an aspect of the present invention.

Referring to the drawings, wherein like reference numerals are used to indicate like or analogous components throughout the several views, and with particular reference to FIGS. 1-7, there is illustrated an exemplary embodiment foot and toe cleaning device or cleaning device 10. The device 10 includes an elongate member, shaft portion, or handle 12, at least one housing 20, at least one agitation mechanism 30, and at least one securement member 40. The at least one housing 20 may extend out away from the proximal end of the elongate member 12. The at least one agitation mechanism 30 may be coupled to the at least one housing 20 and the at least one securement member 40. The at least one securement member 40 may be positioned on the proximal end of the at least one housing 20. The cleaning device 10 may also include a cleaning apparatus 60 removably coupled to the at least one securement member 40, as shown in FIGS. 6-7.

Figure 1:
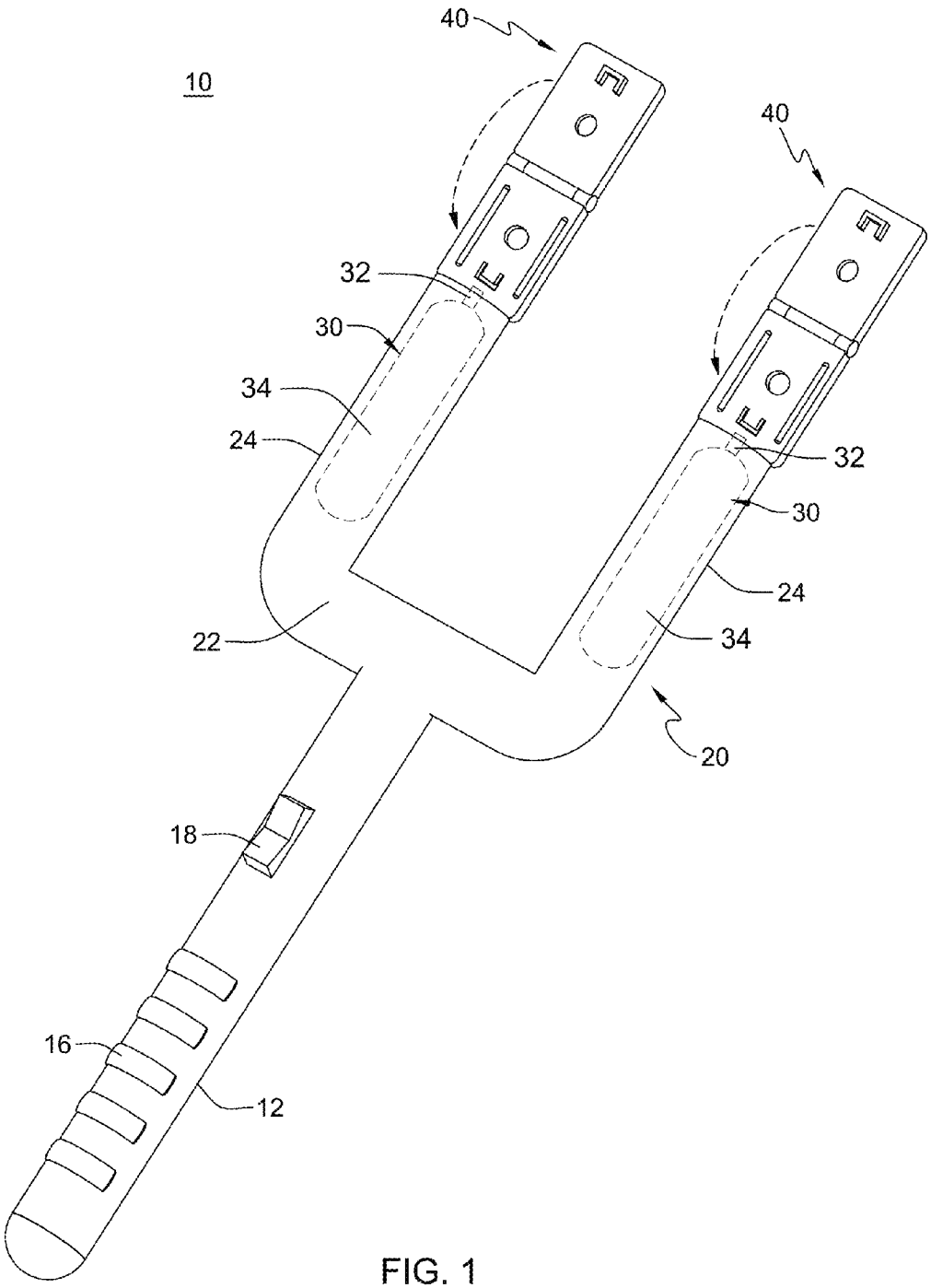
FIG. 1 is a front view of a cleaning device, in accordance with an aspect of the present invention.
Figure 2:
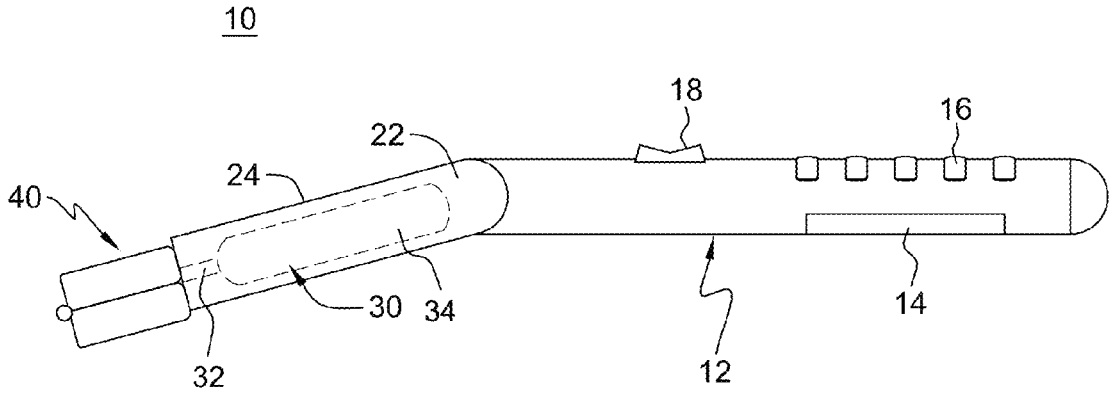
FIG. 2 is a side view of the cleaning device of FIG. 1, in accordance with an aspect of the present invention.

As seen in FIGS. 1 and 2, the elongate member 12 may include a power source cavity (not shown) and a cover 14 along the longitudinal axis of the elongate member 12. The cover 14 may be aligned with the outer surface of the elongate member 12 and over the power source cavity to secure the power source (not shown) within the elongate member 12. The power source may be, for example, at least one battery. Alternatively, the elongate member may include a rechargeable power source and in place of the cover 14 the elongate member 12 may include a plug mechanism (not shown) for connecting the rechargeable power source to an external power source for charging. Alternative power sources (not shown), as known by one of skill in the art, are also contemplated. The elongate member 12 may also include at least one grip portion 16 along the longitudinal axis of the elongate member 12 to assist a user in holding the device 10. A switch 18 may also be positioned on the elongate member 12 enabling a user to activate and deactivate the at least one agitation mechanism 30. The power source (not shown) may be electrically coupled to the switch 18. In an alternative embodiment (not shown), the elongate member 12 may be extendable to enable a user to adjust the length of the cleaning device 10 to a desired length for the user to comfortably reach the bottom of his or her foot and between the toes. Although the elongate member 12 is shown as being straight, the elongate member 12 may in alternative embodiments be, for example, bent or curved at any point along the longitudinal axis of the elongate member 12 to enable the user to reach the desired body part with greater ease.

The at least one housing 20, as shown in FIGS. 1 and 2, includes a base 22 with two prongs 24 extending out from the base 22 and away from the elongate member 12. As shown in FIG. 2, the at least one housing 20 may be angled relative to the longitudinal axis of the elongate member 12. The at least one housing 20 may be angled, for example, from approximately 0 degrees to 90 degrees, preferably from about 30 degrees to 60 degrees, and more preferably between about 40 and 50 degrees. The angled housing 20 may assist a user in reaching under their foot and between their toes, especially, when the user has limited flexibility or mobility. The two prongs 24 may be, for example, parallel. The housing 20, specifically the two prongs 24, may be extendable or telescoping to enable a user to adjust the length of the cleaning device 10 to a desired length for the user to comfortably reach the bottom of his or her foot and between the toes. The base 22 of the housing 20 may also be adjustable to enable the user to adjust the width or distance between the prongs 24 for various foot sizes as well as adjustment from a size for cleaning the entire foot to a size for cleaning between the toes. The two prongs 24 may also include an inner cavity (not shown) for housing the at least one agitation mechanism 30. The agitation mechanism 30 may be electrically connected to the power source and the switch 18 through the housing 20 and the elongate member 18.

Figure 3:
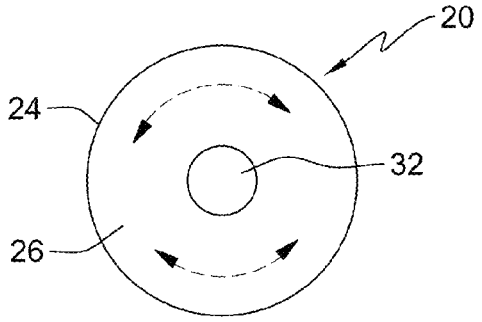
FIG. 3 is a top view of one prong of the cleaning device of FIG. 1 for attaching a securement member, in accordance with an aspect of the present invention.

As seen in FIG. 3, the agitation mechanism 30 may include a pin 32 extending out from a body 34. The pin 32 may extend through a superior portion 26 of the housing 20 to removably couple to the securement member 40. The pin 32 of the agitation mechanism 30 may move in response to the motion of the body 34 of the agitation mechanism 30. The agitation mechanism 30 may include a motor or other motion generating mechanism (not shown) to enable movement of the agitation mechanism 30 when a power source is activated. The agitation mechanism 30 may, for example, rotate, vibrate, pulse, oscillate, or perform another motion to move the cleaning apparatus 60. In one embodiment the cleaning device 10 may include a first agitation mechanism 30 and a second agitation mechanism 30, which both operate to move the cleaning apparatus 60. For example, if the first and second agitation mechanisms 30 are rotation mechanisms the first and second mechanisms 30 will alternatively pull the cleaning apparatus 60 back and forth to gently clean a person's foot and toes or other body parts as the cleaning apparatus 60 passes over the foot and toes or other body part. In an alternative embodiment, the cleaning device 10 may include an agitation mechanism 30 and a movement mechanism (not shown), wherein the agitation mechanism 30 moves and the movement mechanism is free to move in response to the force exerted on the cleaning apparatus 60 by the agitation mechanism 30. For example, if the agitation mechanism 30 is a rotating mechanism, as the agitation mechanism 30 turns back and forth, a force is exerted on the cleaning apparatus 60 and the movement mechanism would allow for rotating in response to a force exerted by the cleaning apparatus 60.

The securement member 40 may include a first arm 42, a second arm 50, and a hinge member 54 connecting the first arm 42 and the second arm 50, as shown in FIG. 4. The securement member 40 may also include a fastener to secure the first arm 42 to the second arm 50. The fastener may include a first clasp member 46 on an interior surface of the first arm 42 and a second clasp member 52 on an interior surface of the second arm 50. The first arm 42 may also include an attachment mechanism 44, for example, a peg, for coupling to the cleaning apparatus 60 on the interior surface of the first arm 42. In addition, the first arm 42 may include at least one grip member 48 to assist in holding the cleaning apparatus 60 in the securement member 40. The securement member 40 may also include an attachment portion (not shown) on the inferior side of the securement member 40 for attaching the securement member 40 to the pin 32 of the agitation mechanism 30 to enable movement of the securement member 40 in response to movement of the agitation mechanism 30. Once secured to the agitation mechanism 30, the securement member 40 may move freely with respect to the housing 20. Alternative, securement members 40, which include an attachment portion to secure the securement members 40 to the at least one housing 20 and a portion to attach a cleaning apparatus 60, are also contemplated.

As shown in FIG. 5, the cleaning apparatus 60 may include a cleaning portion 62, a first attachment portion 64 at a first end of the cleaning portion 62, and a second attachment portion 66 at a second end of the cleaning portion 62. The first attachment portion 64 may include at least one aperture 68 and the second attachment portion 66 may include at least one aperture 70. In the depicted embodiment, the at least one apertures 68, 70 are each three apertures allowing for adjustment of the tension of the cleaning apparatus 60. The cleaning apparatus 60 may be, for example, a cloth, brush, or the like. The cleaning apparatus 60 may be removable to enable the cleaning apparatus 60 to be cleaned or sterilized. Alternatively, the cleaning apparatus 60 may be disposable allowing for the cleaning apparatus 60 to be disposed of after each use in order to prevent transfer of any bacteria or fungus that may be on the users' foot back to the user or to a subsequent user.

Referring now to FIG. 6, the at least one aperture 68 of the first attachment portion 64 may engage peg 44 of the securement member 40 that is coupled to a first prong 24. Once the at least one aperture 68 of the cleaning apparatus 60 is inserted onto the peg 44 of the securement member 40, the second arm 50 of the securement member 40 may be closed and secured to the first arm 42 of the securement member 40, as shown in FIG. 6. Then the at least one aperture 70 of the cleaning apparatus 60 may be inserted over the peg 44 of the securement member 40 at a desired tension and the second arm 50 of the securement member 40 may be closed and secured to the first arm 42 of the securement member 40 to secure the cleaning apparatus 60 to the housing 20. A top view of the cleaning device 10 is shown in FIG. 7, after the cleaning apparatus 60 is attached to the two securement members 40 and the securement members 40 are closed. FIG. 7 also shows rotation of the securement members 40 of the device 10 where the agitation mechanisms 30 are rotators.

The foot and toe cleaning device 10 may also include a pressure sensor (not shown) and an indicator (not shown) to notify the user if they are applying too much pressure to their skin while they are cleaning their foot and toes or other body parts. The pressure sensor may be, for example, coupled to the cleaning apparatus 60, the securement members 40, or the housing 20. The indicator may be, for example, a light which may be placed, for example, on the elongate member 12 to notify the user if too much pressure is being applied to their foot. Alternatively, the indicator may be a sound, for example, a buzz or chime to notify the user by sound that they are using too much pressure. In yet another alternative embodiment, the indicator may be both a visual and sound indicator, for example, a light and a buzzer, to enable people with either a visual or hearing impairment to still be notified if they are applying too much pressure to their foot.

Figure 8:
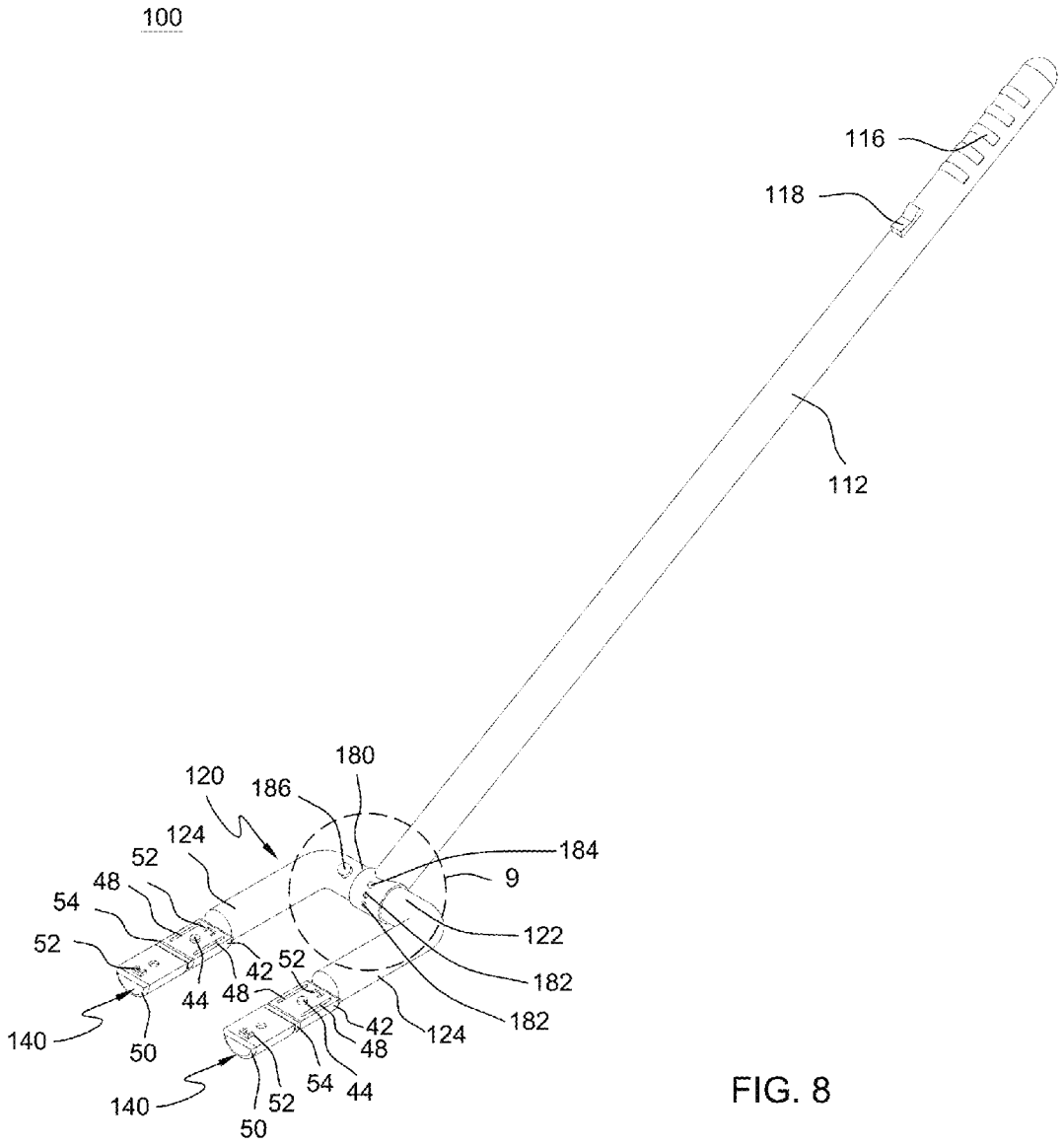
FIG. 8 is an isometric view of another embodiment of a cleaning device, in accordance with an aspect of the present invention.
Figure 9:
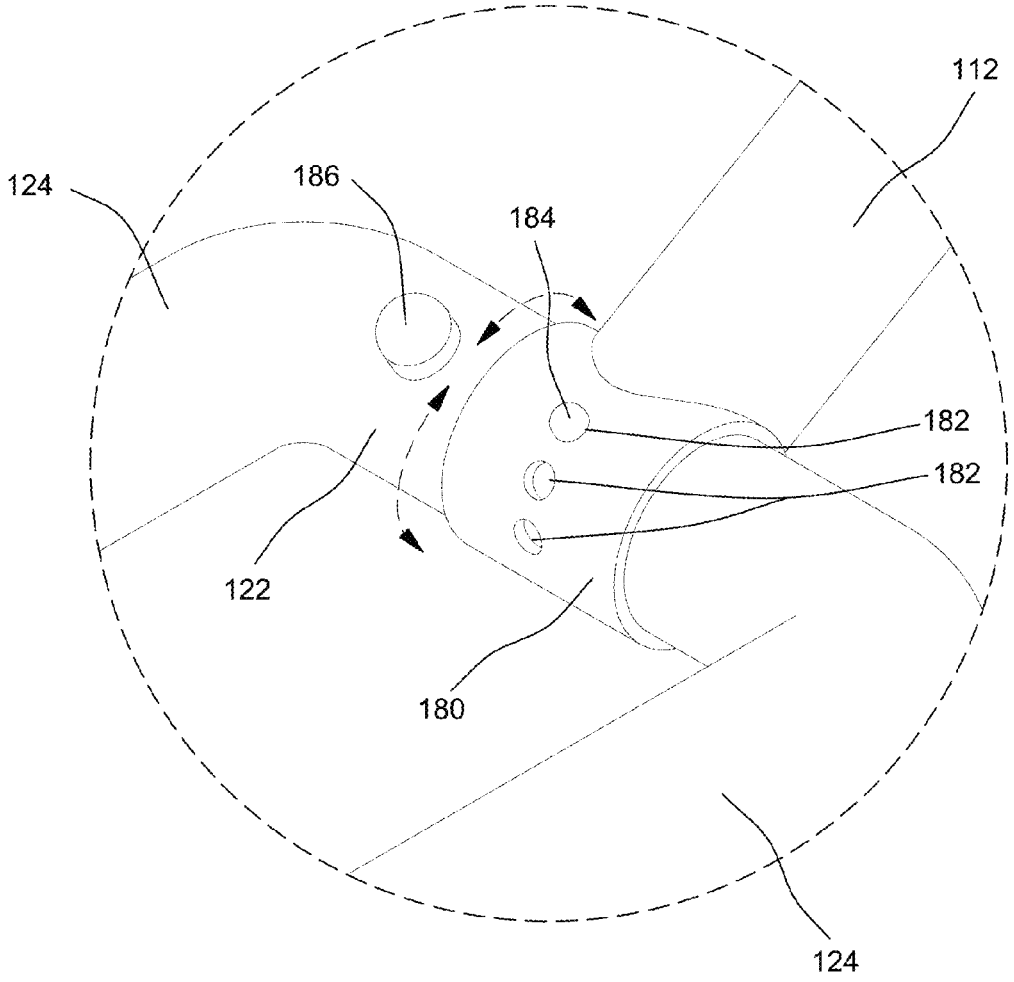
FIG. 9 is an enlarged view of the rotation mechanism of the cleaning device of FIG. 8, in accordance with an aspect of the present invention.
Figure 10:
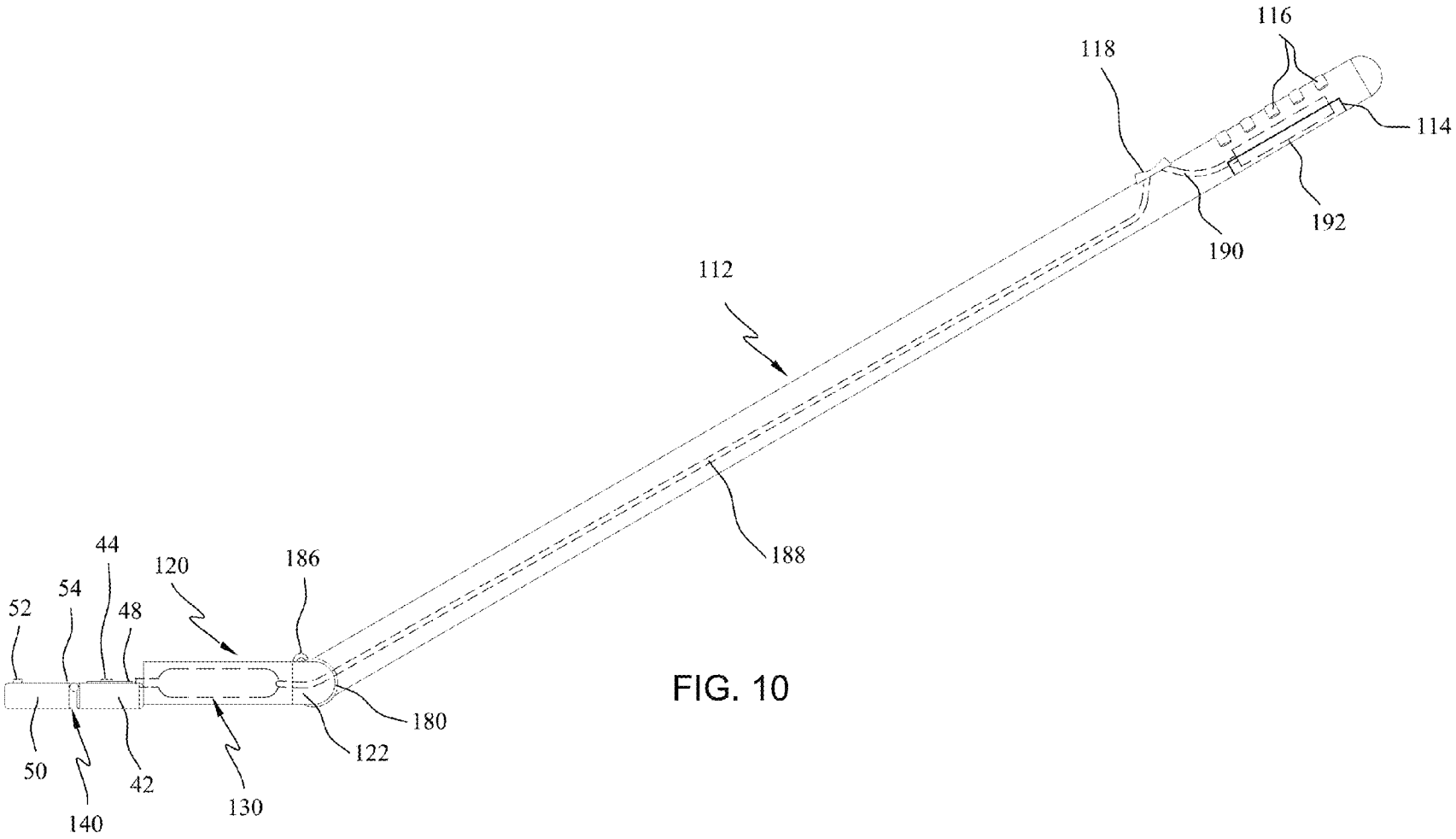
FIG. 10 is a side view of the cleaning device of FIG. 8 showing the internal movement mechanism, power source, and electrical wires, in accordance with an aspect of the present invention.

Referring now to FIGS. 8-10, another cleaning device 100 is illustrated. The cleaning device 100 may include an elongate member or handle 112, at least one housing 120, and at least one agitation mechanism 130. The cleaning device 100 may also include at least one securement mechanism 140. The elongate member 112, at least one housing 120, at least one agitation mechanism 130, and at least one securement mechanism 140 may be of the type described above with reference to elongate member 12, at least one housing 20, at least one agitation mechanism 30, and at least one securement mechanism 40, respectively, of cleaning device 10 and which will not be described again here for brevity sake.

The cleaning device 100 may also include an adjustment portion 180. The adjustment portion 180 may be secured to the elongate member 112 and rotatably coupled to the base 122 of the at least one housing 120. The adjustment portion 180 may include a plurality of openings 182 positioned, for example, in a line along a central portion of the adjustment portion 180 and evenly spaced apart. The openings 182 may be positioned to allow the base 122 to be angled relative to the handle 112 from, for example, approximately 0° to 90° and, more specifically, at approximately 0°, 30°, 45°, 60°, and 90°. The base 122 may also include an engagement protrusion 184 for engaging the plurality of openings 182 in the adjustment portion 180. In addition, the base 122 may include a button 186 coupled to the engagement protrusion 184 to enable the engagement protrusion 184 to be depressed within the base 122. As the engagement protrusion 184 is depressed, the base 122 is able to rotate relative to the handle 112. Once the desired angle of the base 122 relative to the handle 112 is achieved, the button 186 may be released and the engagement protrusion 184 will engage the aligned opening 182 to secure the housing 120 in the desired angle with respect to the elongate member 112. Alternative adjustment portions 180 are also contemplated, as know by one of skill in the art, which would enable the at least one housing 120 to pivot or rotate relative to the elongate member 112.

The cleaning device 100 may also include the cleaning apparatus 60, shown in FIG. 5. The cleaning apparatus 60 may be secured to the device 100 with at least one securement mechanism 140, as described above with reference to cleaning device 60 being attached to device 10 with securement mechanism 40 and which will not be described again here for brevity sake.

As shown in FIG. 10, the agitation mechanisms 130 may be electrically coupled to the switch 118 with a first wire 188 and the switch 118 may be electrically coupled to a power supply 192 by a second wire 190. The power supply 192 may fit into a cavity within the handle 112 and be secured within the handle by cover 114. The cover 114 may be of the type described above with reference to cover 14, which will not be described again here for brevity sake. As described in greater detail above, the power supply 192 may be, for example, at least one battery, as shown in FIG. 10, or alternatively, a rechargeable power source (not shown) which may include a plug or charging station. In an embodiment with a rechargeably power source, the cover 114 may be replaced with a uniform handle portion or alternatively may include a mechanism for engaging the plug or charging station to recharge the device 100. Alternative power sources (not shown), as known by one of skill in the art, are also contemplated.

As shown in FIG. 10, the agitation mechanisms 130 may be positioned within the housing 120 to enable movement of the securement mechanisms 140 and in turn the cleaning apparatus 60. In alternative embodiments (not shown), the agitation mechanisms 130 may be positioned inside the elongate member 112 at a proximal end to enable movement of the housing 120, securement mechanisms 140, and any attached cleaning apparatus 60. In yet other alternative embodiments (not shown), the agitation mechanisms 130 may be positioned partially within both the housing 120 and the elongate member 112 to enable movement of the securement mechanisms 140 and any attached cleaning apparatus 60.

The elongate member 112 of the cleaning device 100 may come in various lengths to correspond to the various heights of users. Alternatively, as described in greater detail above, the elongate member 112 may be extendable or telescoping to allow for the user to adjust the length of the cleaning device 100 to a desired length for reaching the bottom of a user's foot and/or between their toes. Also, as described in greater detail above, the elongate member 112 may be, for example, straight, bent, or curved at any point along the longitudinal axis of the elongate member 112 to enable the user to reach the desired body part with greater ease.

Figure 11:
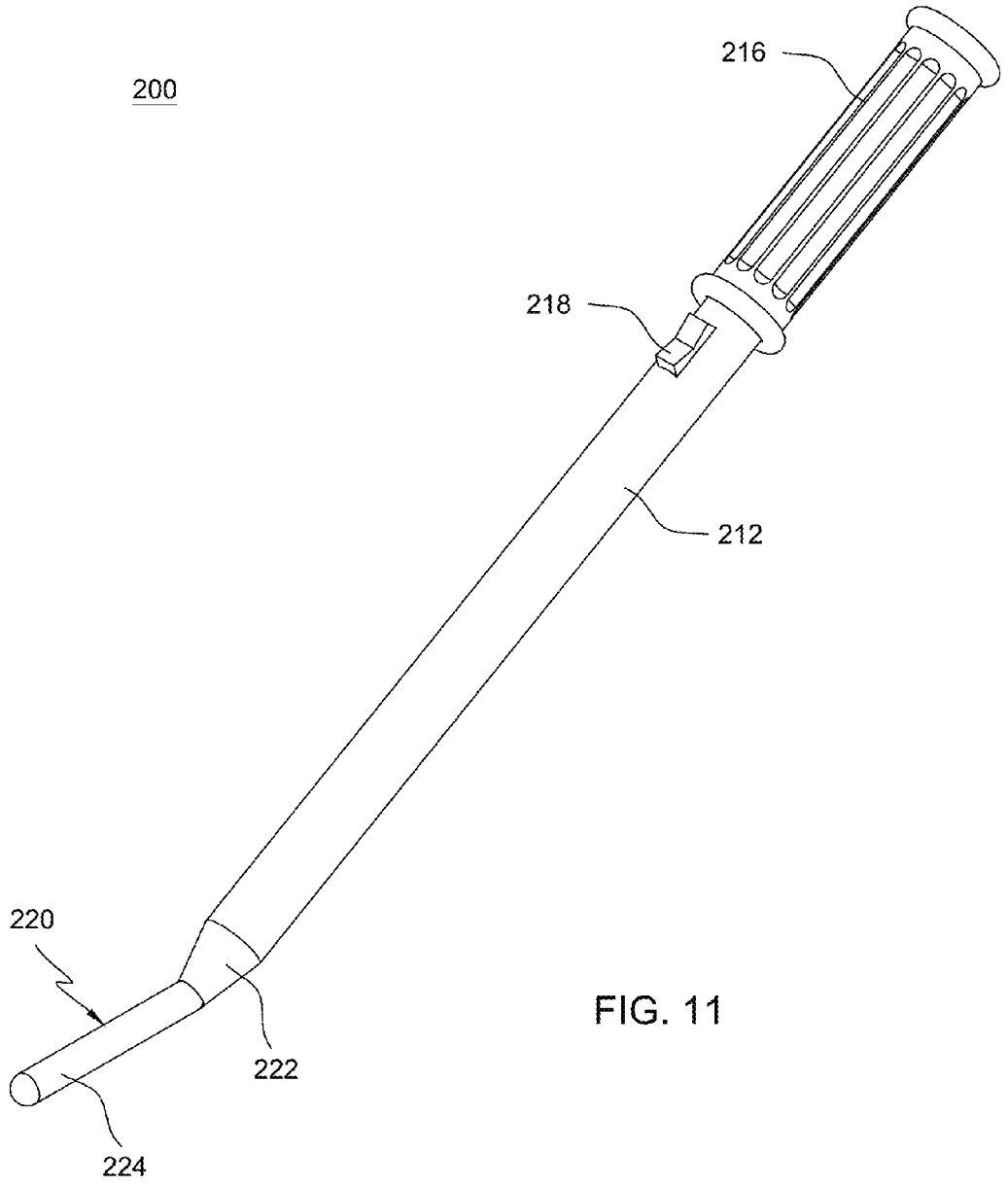
FIG. 11 is an isometric view of another embodiment of a cleaning device, in accordance with an aspect of the present invention.
Figure 12:
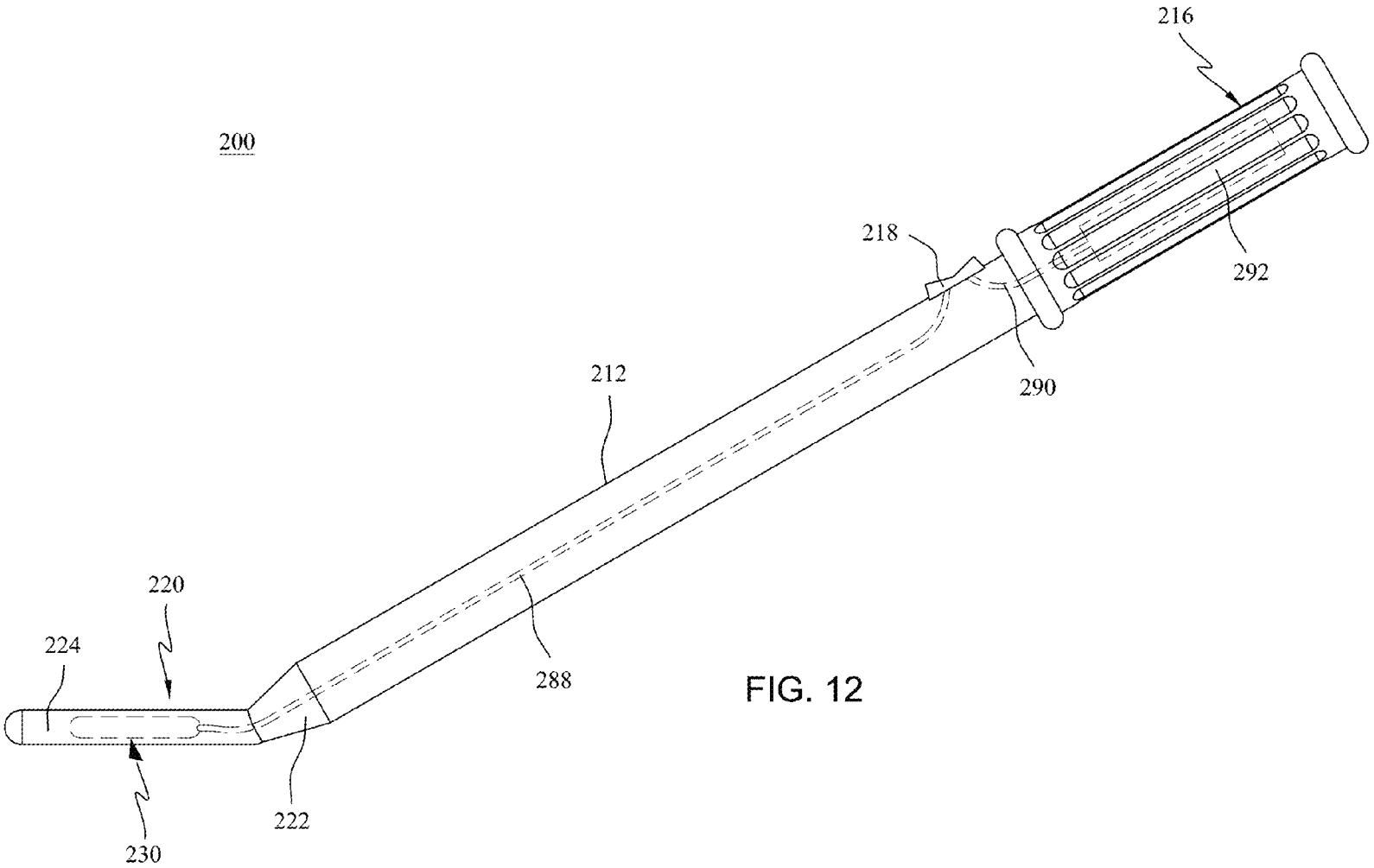
FIG. 12 is a side view of the cleaning device of FIG. 11 showing the internal movement mechanism, power source, and electrical wires, in accordance with an aspect of the present invention.
Figure 13:
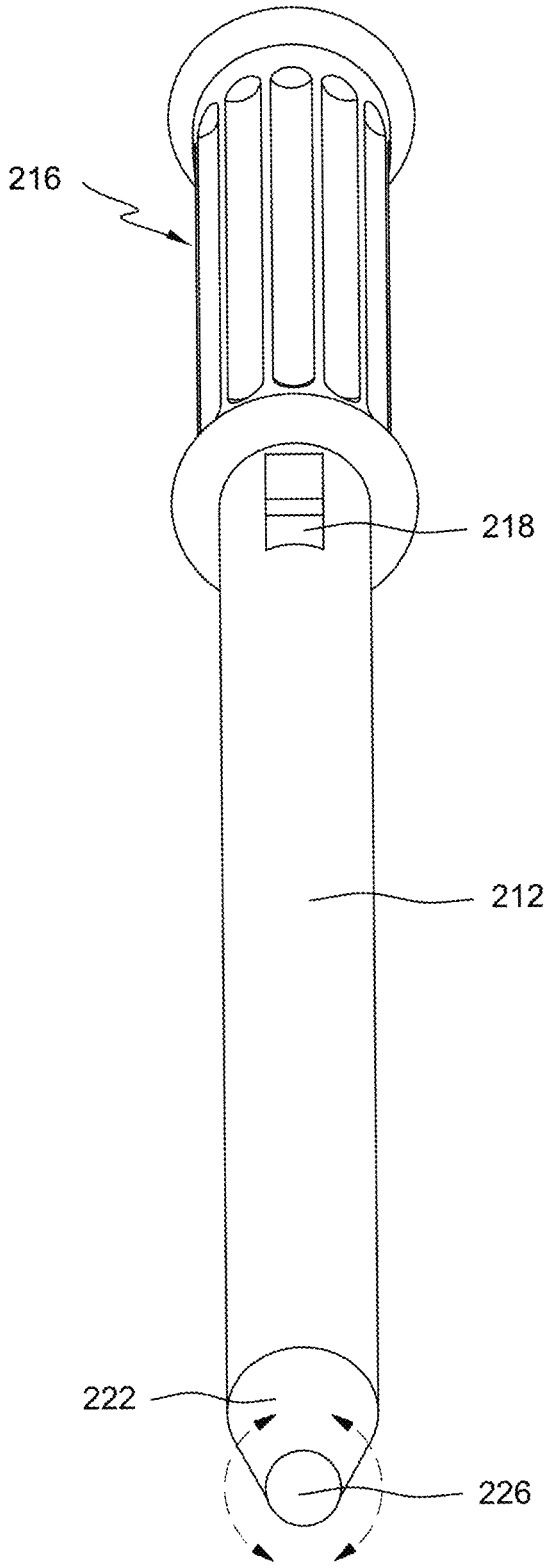
FIG. 13 is an isometric view of the shaft portion of the cleaning device of FIG. 11, in accordance with an aspect of the present invention.

Another cleaning device 200 is shown in FIGS. 11-15. The cleaning device 200 may include an elongate member 212, at least one housing 220, and at least one agitation mechanism 230. The elongate member or shaft portion 212 may include a handle 216 at a first end, a switch 218 positioned between the first end and the second end, and an opening 226 at a second end, as shown in FIG. 13. The elongate member 212 may also be coupled to a base 222 and the base 222 may be, for example, removably coupled to the elongate member 212 or an integral portion of the elongate member 212.

In addition, the elongate member 212 may include a power source 292, as shown in FIG. 12. The power source 292 may be, for example, at least one battery, which may be inserted into a cavity within the elongate member 212. The cavity holding the power source 292 may have a cover (not shown) that is positioned over a cavity. Or alternatively, the power source 292 may be, for example, a rechargeable power source with an adapter for a plug or charging station positioned on the elongate member 212 instead of a cover (not shown) in order to recharge the power source 292. The power source 292 may be electrically connected to the switch 218 by, for example, a wire or cable 290. Alternative power sources (not shown), as known by one of skill in the art, are also contemplated. The handle 216 may be used to assist the user with holding the device 200 while cleaning their feet. Alternative handles or gripping portions as known by one of skill in the art or such as grip portion 16, 116, as described in greater detail above, are also contemplated. The elongate member 212 may also be, for example, adjustable to enable the user to extend or retract the elongate member 212 to increase or decrease the length of the device 200. Also, as described in greater detail above, the elongate member 212 may be, for example, straight, bent, or curved at any point along the longitudinal axis of the elongate member 212 to enable the user to reach the desired body part with greater ease.

As shown in FIGS. 11-12, the housing 220 may include at least one member 224 which may be, for example, a flexible member. The at least one member 224 of the housing 220 may couple with the elongate member 212 at a base 222. The at least one member 224 may be positioned, for example, in the opening 226 of the base 222 and secured to a proximal end of the elongate member 212, allowing for the at least one member 224 to bend in any direction relative to the elongate member 212. It is also contemplated that the at least one member 224 may be secured to the base 222 and the base 222 then removably coupled to the elongate member 212. In an embodiment where the at least one member 224 is a flexible member, the at least one member 224 may be bent or curved by the user anywhere along the longitudinal axis of the at least one member 224 to provide a better position for the user to reach their feet, toes, or other body part for cleaning. The flexible member may be made of a material that is deformable while also being sufficiently rigid to prevent the at least one member 224 from changing the position or orientation while the user is cleaning their feet, toes, or other body part. The flexible member may also be able to be bent or curved by the user to other positions or orientations for cleaning the other foot, toes, or other body parts.

The at least one agitation mechanism 230 may be positioned, for example, within the at least one member 224 of the housing 220, as shown in FIG. 12. In alternative embodiments (not shown), the agitation mechanism 230 may be positioned inside the base 222 and/or the elongate member 212 at a proximal end to enable movement of the housing 220 and any attached cleaning apparatus 260, 270. In yet other alternative embodiments (not shown), the agitation mechanism 230 may be positioned within the housing 220, base 222, and the elongate member 212 to enable movement of the securement mechanism 240 and any attached cleaning apparatus 260, 270. The agitation mechanism 230 may include, for example, a motor (not shown) or other motion generating mechanism to enable movement of the agitation mechanism 230 when the power source 292 is activated. The agitation mechanism 230 by, for example, the motor or other motion generating mechanism, may rotate, vibrate, pulse, oscillate, or perform other motion to move the at least one member 224 of the housing 220. The agitation mechanism 230 may be electrically connected to the switch 218 by, for example, a wire or cable 288 to couple the agitation mechanism 230 to the power source 292.

Figure 14:
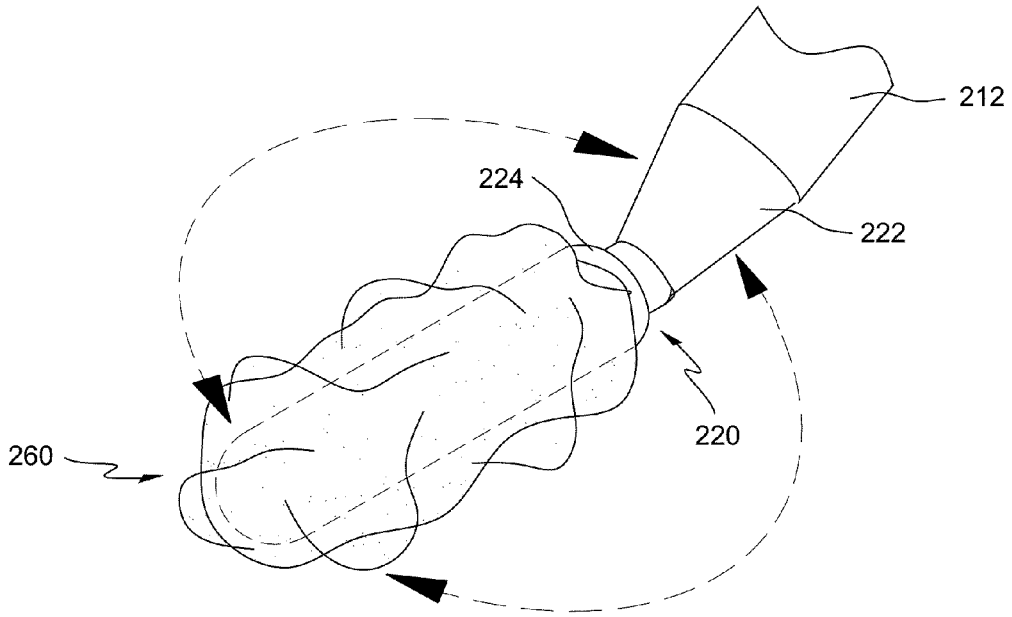
FIG. 14 is a first head portion of the cleaning device of FIG. 11, in accordance with an aspect of the present invention.
Figure 15:
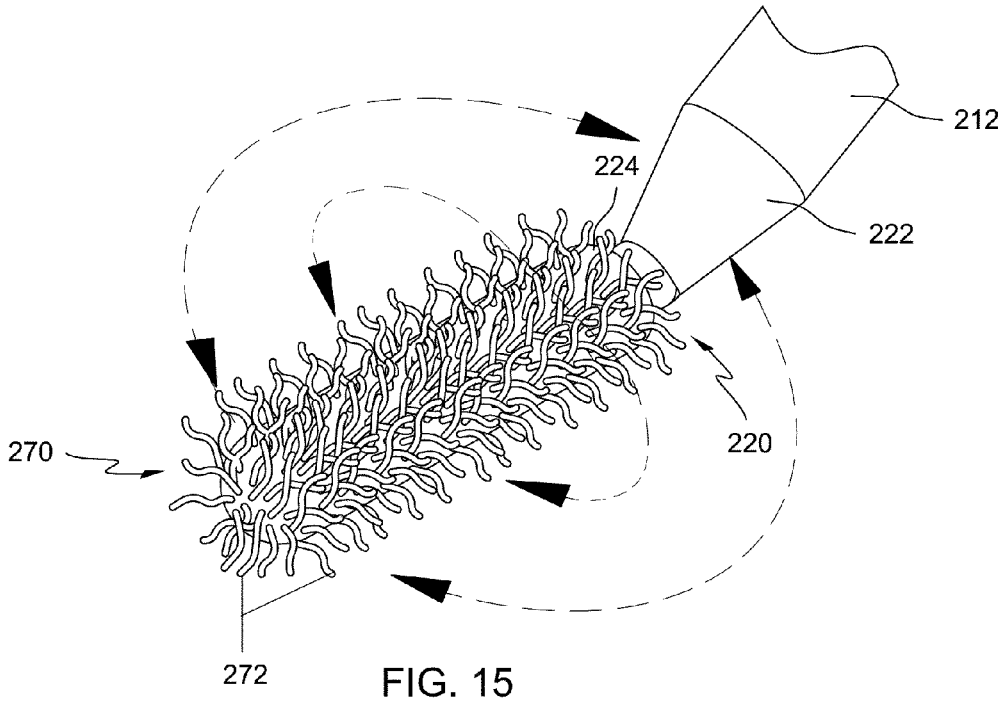
FIG. 15 is a second head portion of the cleaning device of FIG. 11, in accordance with an aspect of the present invention.

As shown in FIGS. 14-15, different cleaning apparatuses 260, 270 may be positioned over the at least one member 224 of the housing 220. The cleaning apparatus 260 may come in, for example, various textures ranging from smooth to relatively rough for selection by the user. The cleaning apparatus 260 may be, as shown in FIG. 14, for example, a cloth which slides over the at least one member 224 for cleaning and may then either be washed or disposed of. The cleaning apparatus 260 may, for example, contain an elastic member (not shown) surrounding the opening (not shown) to secure the cleaning apparatus 260 onto the at least one member 224 during cleaning. The at least one member 224 may also include, for example, a corresponding groove (not shown) to receive the elastic member (not shown) of the cleaning apparatus 260. Alternative means for removably securing the cleaning apparatus 260 to the at least one member 224, as known by one of ordinary skill in the art, are also contemplated. The at least one member 224, as shown in FIG. 14, may have an agitation mechanism 230 that, for example, vibrates to move the at least one member 224 and cleaning apparatus 260 to clean between a user's toes. However, other agitation mechanisms 230 that rotate, pulse, oscillate, or perform another motion to move the cleaning apparatus 260 are also contemplated.

In an alternative embodiment of FIG. 14, the cleaning apparatus 260 may be integrated with the at least one member 224 of the housing 220. The at least one member 224 with the integrated cleaning apparatus 260 may be, for example, removable and replaceable. In an embodiment with a removable and replaceable member 224, the agitation mechanism 230 may be positioned, for example, within the base 222 and/or within the elongate member 212. The at least one member 224 with the integrated cleaning apparatus 260 may also be a flexible member as described in greater detail above and which will not be described again here for brevity sake.

The cleaning apparatus 270, as shown in FIG. 15, may be for example, a bristled attachment including a plurality of bristles 272 which may be slid over the at least one member 224. After the cleaning apparatus 270 has been used it may be removed and either washed or disposed of. The cleaning apparatus 270 may also, for example, include an elastic member (not shown) surrounding the opening (not shown) to secure the cleaning apparatus 270 onto the at least one member 224 during cleaning. As discussed above, the corresponding groove (not shown) of the at least one member 224 may receive the elastic member (not shown) of the cleaning apparatus 270. Alternative means for removably securing the cleaning apparatus 270 to the at least one member 224, as known by one of ordinary skill in the art, are also contemplated. The at least one member 224, as shown in FIG. 15, may have an agitation mechanism 230 that, for example, rotates to move the at least one member 224 and cleaning apparatus 270 to clean between the user's toes. However, other agitation mechanisms 230 that vibrate, pulse, oscillate, or perform another motion to move the cleaning apparatus 270 are also contemplated.

In an alternative embodiment of FIG. 15, the bristles 272 may be integrated directly into the at least one member 224 of the housing 220. The at least one member 224 with the integrated bristles 272 may be, for example, removable and replaceable. In an embodiment with a removable and replaceable member 224, the agitation mechanism 230 may be positioned within the base 222 and/or within the elongate member 212. The at least one member 224 with the integrated bristles 272 may also be a flexible member as described in greater detail above and which will not be described again here for brevity sake.

The cleaning devices 100 and 200 may also include a pressure sensor (not shown) and/or an indicator (not shown) as described above with reference to cleaning device 10 and which will not be discussed again here for brevity sake.

Figure 16:
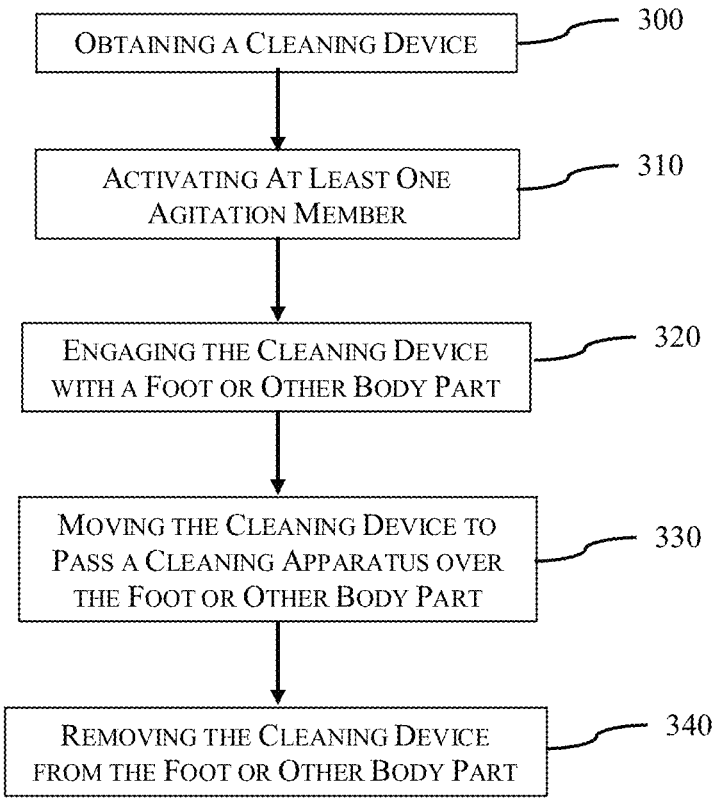
FIG. 16 depicts one embodiment of a method of cleaning a foot using a cleaning device of FIG. 1, 8, or 11, in accordance with an aspect of the present invention.

An example method of cleaning a foot using the cleaning device 10, 100, or 200, as shown in FIG. 16, includes obtaining a cleaning device 300. The method also includes activating the at least one agitation member to move the cleaning apparatus 310. Further, the method includes engaging the cleaning apparatus with a portion of the foot or other body part 320 and moving the cleaning device to pass the cleaning apparatus over at least a portion of the foot or other body part 330. Finally, the method includes removing the cleaning device from the foot or other body part 340.

Although described primarily with reference to a user's feet and toes, the cleaning devices 10, 100, and 200 may also be used to clean other parts of a user's body.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has", and "having"), "include" (and any form of include, such as "includes" and "including"), and "contain" (and any form of contain, such as "contains" and "containing") are open-ended linking verbs. As a result, a method or device that "comprises," "has," "includes," or "contains" one or more steps or elements possesses those one or more steps or elements, but is not limited to possessing only those one or more steps or elements. Likewise, a step of a method or an element of a device that "comprises," "has," "includes," or "contains" one or more features possesses those one or more features, but is not limited to possessing only those one or more features. Furthermore, a device or structure that is configured in a certain way is configured in at least that way, but may also be configured in ways that are not listed.

As may be recognized by those of ordinary skill in the art based on the teachings herein, numerous changes and modifications may be made to the above-described and other embodiments of the present invention without departing from the scope of the invention. The elongate member, shaft portion, or handle, at least one housing, at least one agitation mechanism, at least one securement mechanism, an adjustment portion, a base, and other components of the devices as disclosed in the specification, including the accompanying abstract and drawings, may be replaced by alternative component(s) or feature(s), such as those disclosed in another embodiment, which serve the same, equivalent or similar purpose as known by those skilled in the art to achieve the same, equivalent or similar results by such alternative component(s) or feature(s) to provide a similar function for the intended purpose. In addition, the devices and systems may include more or fewer components or features than the embodiments as described and illustrated herein. For example, the components and features of FIGS. 1-7, FIGS. 8-10, and FIGS. 11-15 may all be used interchangeably and in alternative combinations as would be modified or altered by one of skill in the art. Additionally, as may be recognized by those of ordinary skill in the art based on the teachings herein, the agitation mechanism can be of any of numerous types of agitation mechanism that are currently known or that later become known to move the at least one housing to clean a users foot or toes; additionally, more than one agitation mechanism could be employed. Further, as may be recognized by those of ordinary skill in the art based on the teachings herein, the pressure sensor and pressure indicator can be of any of numerous types of pressure sensors and pressure indicators that are currently known or that later become known to sense and alert the user to the use of too much pressure on the foot or toes; additionally, more than one pressure sensor and/or pressure indicator may be employed. Accordingly, this detailed description of the currently-preferred embodiments is to be taken in an illustrative, as opposed to limiting of the invention.

The invention has been described with reference to the preferred embodiments. It will be understood that the architectural and operational embodiments described herein are exemplary of a plurality of possible arrangements to provide the same general features, characteristics, and general system operation. Modifications and alterations will occur to others upon a reading and understanding of the preceding detailed description. It is intended that the invention be construed as including all such modifications and alterations.

Having thus described the preferred embodiments, the invention is now claimed to be:

1. A cleaning device, comprising:

an elongate member;

at least one housing coupled to a proximal end of the elongate member;

at least one agitation mechanism movably coupled to the at least one housing;

a cleaning apparatus removably coupled to the at least one housing; and at least one securement member on a first end of the at least one housing and coupled to the at least one agitation mechanism, wherein the securement member comprises:

a first arm;

a second arm;

a hinge member coupling the first arm and the second arm;

at least one fastener to secure the first arm to the second arm;

at least one attachment mechanism for coupling the cleaning apparatus to the securement member; and at least one grip member on the first arm.

2. The cleaning device of claim 1, wherein the elongate member comprises:

at least one grip portion on a distal end of the elongate member.

3. The cleaning device of claim 1, wherein the elongate member further comprises:

a power source cavity; and a cover removably positioned over the power source cavity.

4. The cleaning device of claim 3, further comprising:

a power source for providing power to the at least one agitation mechanism.

5. The cleaning device of claim 4, wherein the power source is positioned in the power source cavity.

6. The cleaning device of claim 5, further comprising:

a switch for activating the power source and the at least one agitation mechanism.

7. The cleaning device of claim 1, wherein the at least one housing comprises:

a base; and at least one prong extending out from the base and away from the elongate member.

8. The cleaning device of claim 7, wherein the at least one prong comprises two prongs positioned generally parallel to each other and generally perpendicular to the base.

9. The cleaning device of claim 8, wherein each of the two prongs comprises an inner cavity and each inner cavity receives an agitation mechanism of the at least one agitation mechanism.

10. The cleaning device of claim 9, wherein the at least one housing is angled with respect to the elongate member.

11. The cleaning device of claim 10, wherein the angle ranges from 0 degrees to 90 degrees.

12. The cleaning device of claim 1, wherein the agitation mechanism comprises:

a body; and a pin extending out from the body in a proximal direction and passing out of a superior portion of the at least one housing to couple to the securement member.

13. The cleaning device of claim 1, further comprising:

a pressure sensor; and an indicator on the elongate handle coupled to the pressure sensor.

14. The cleaning device of claim 1, wherein the cleaning apparatus comprises:

a cleaning portion;

a first attachment portion at a first end of the cleaning portion; and a second attachment portion at a second end of the cleaning portion.

15. The cleaning apparatus of claim 14, further comprising:

at least one aperture in the first attachment portion; and at least one aperture in the second attachment portion.

16. The cleaning apparatus of claim 15, wherein the at least one aperture in the first attachment portion comprises three apertures and the at least one aperture in the second attachment portion comprises three apertures.

* * * * *